US008678799B2

(12) United States Patent
Casey et al.

(10) Patent No.: US 8,678,799 B2
(45) Date of Patent: Mar. 25, 2014

(54) SPINNING CELL FOR SYNTHETIC FIBER

(75) Inventors: John T. Casey, Waynesboro, VA (US); James B. Elmore, Crimora, VA (US); Charles P Deturk, Newark, DE (US); David A. Wilson, Waynesboro, VA (US)

(73) Assignee: Invista North America S.ár.l., Wilmington, DE (US)

( * ) Notice: Subject to any disclaimer, the term of this patent is extended or adjusted under 35 U.S.C. 154(b) by 353 days.

(21) Appl. No.: 12/922,554

(22) PCT Filed: Mar. 19, 2009

(86) PCT No.: PCT/US2009/037591

§ 371 (c)(1),
(2), (4) Date: Oct. 7, 2010

(87) PCT Pub. No.: WO2009/117536

PCT Pub. Date: Sep. 24, 2009

(65) Prior Publication Data

US 2011/0018163 A1 Jan. 27, 2011

Related U.S. Application Data

(60) Provisional application No. 61/037,881, filed on Mar. 19, 2008.

(51) Int. Cl.
*D01D 5/04* (2006.01)
*D01D 4/08* (2006.01)

(52) U.S. Cl.
USPC ..... 425/72.2; 425/186; 425/188; 425/192 S; 425/377

(58) Field of Classification Search
USPC ..... 425/72.2, 186, 188, 192 S, 377, 382.2, 425/464
See application file for complete search history.

(56) References Cited

U.S. PATENT DOCUMENTS

| | | | | | |
|---|---|---|---|---|---|
| 1,952,877 | A | * | 3/1934 | Mancini | 425/72.2 |
| 2,551,684 | A | * | 5/1951 | Lodge | 425/72.2 |
| 3,274,644 | A | * | 9/1966 | Massey et al. | 425/72.2 |
| 3,902,834 | A | * | 9/1975 | Hagenburg | 425/73 |
| 4,627,811 | A | * | 12/1986 | Greiser et al. | 425/72.2 |
| 4,681,522 | A | * | 7/1987 | Lenk | 425/72.2 |
| 5,002,474 | A | | 3/1991 | Hoekstra | |
| 5,387,387 | A | | 2/1995 | James et al. | |
| 6,248,273 | B1 | | 6/2001 | Benin et al. | |

FOREIGN PATENT DOCUMENTS

| | | |
|---|---|---|
| GB | 317368 | 7/1930 |
| GB | 980720 | 1/1965 |
| JP | 2003201618 | 7/2003 |

* cited by examiner

*Primary Examiner* — Yogendra Gupta
*Assistant Examiner* — Joseph Leyson
(74) *Attorney, Agent, or Firm* — Christina W. Geerlof

(57) ABSTRACT

Included is a spinning cell for a synthetic fiber such as spandex. The spinning cell includes a top closure which reduces or eliminates solvent vapor transfer, where solvent vapor process gas(es) may leave the cell and room air may be introduced into the spinning cell. A bottom closure device may also be included.

9 Claims, 7 Drawing Sheets

SPINNING CELL FOR SYNTHETIC FIBER

CROSS-REFERENCE TO RELATED APPLICATIONS

This is the National Stage of International Application No. PCT/US2009/037591, filed on Mar. 19, 2009, which claims the benefit of U.S. Provisional Patent Application No. 61/037,881 filed on Mar. 19, 2008.

BACKGROUND OF THE INVENTION

1. Field of the Invention

Included is a spinning cell for a synthetic fiber such as spandex. The spinning cell includes a top closure which reduces or eliminates solvent vapor transfer, where solvent vapor process gas(es) may leave the cell and room air may be introduced into the spinning cell.

2. Summary of the Related Technology

Synthetic fiber may be prepared from a variety of processes including melt-spinning and dry-spinning. Dry-spinning of fiber such as spandex may be achieved by preparing a solution of a polymer such as a segmented polyurethane. The solution is then dry-spun through spinneret orifices in a spinning cell to form filaments. Upon emergence from the spinneret, the filaments are forwarded through a chamber of the cell, in which the solvent is evaporated from the filaments by the introduction of hot gases. The filaments may be coalesced and adhered to each other to form a unitary thread; alternatively, threads may be prepared from single filaments. The thread is forwarded from the cell to a windup where it is formed into a yarn package.

When the hot gas includes oxygen, the risk exists that the solvent may ignite. In order to reduce this risk, care is taken to maintain a low concentration of solvent in the cell. This is achieved by forcing large quantities of gas into the spinning cell.

In order to minimize the risk of fire, the gas in the cell may be an inert gas such as nitrogen or carbon dioxide. A closed loop system in which the evaporated solvent is separated from the inert gas and the inert gas is recycled back to the spin cell is often used to reduce operating costs associated with supplying an inert gas to the spin cell. One difficulty with using an inert gas is sealing the spinning cell from the introduction of air into the spinning cell during cell operation and during cleaning/replacement of the spinnerets without purging the cell of solvent vapors and interrupting the gas flow through the spinning cell. When the spinning cell is sealed to prevent the introduction of air, another benefit is that the operator of the cell will have a reduced exposure to the solvent or process gas used in the spinning process.

Many spinning cells are used today which use air instead of an inert gas. These spinning cells frequently have open top and bottom portions through which air is introduced into the spinning cell and through which solvent vapor and process gases may escape. During production interruptions to exchange spinnerets, it is common practice for the flow of drying gas to be maintained through the spinning cell and these cell openings to be open to the manufacturing areas. During the spinneret exchange, there is potential for the drying gas to escape to the surrounding manufacturing area and/or for room air to be drawn into the spin cell. If the spin cell is supplied from a common, closed loop inert gas supply system the oxygen content of the closed gas system could reach hazardous levels if too much room air is drawn into the cell during this operation. Alternatively, excessive release of inert process gas to the manufacturing area will result in increased operating cost to replenish the loss and risk exposing operating personnel to excessive amounts of inert gas. During production interruptions to exchange spinnerets, it is common practice for the flow of drying gas to be maintained through the spinning cell and these cell openings to be open to the manufacturing areas. During production interruptions to exchange spinnerets, it is common practice for the flow of drying gas to be maintained through the spinning cell and these cell openings to be open to the manufacturing areas.

SUMMARY OF THE INVENTION

In some embodiments are a device that may be included in a dry spinning cell or may be used to modify an existing dry spinning cell. This cell includes:

(a) a dry spinning cell for synthetic fiber having a substantially vertical configuration, an open top portion, an open bottom portion, and an array of spinnerets; and (b) a top closure for reducing or eliminating solvent vapor emissions and reducing or eliminating the intrusion of air into said dry spinning cell, wherein said top closure is adjacent to said open top portion of said dry spinning cell.

This dry spinning cell is compatible for use with an inert gas such as carbon dioxide or nitrogen and reduces the risk of fire and personnel exposure to solvent vapors.

In other embodiments are a device including:

(a) a dry spinning cell for synthetic fiber having a substantially vertical configuration, an open top portion, an open bottom portion, and an array of spinnerets;

(b) a top closure for reducing or eliminating solvent vapor transfer and the introduction of air into said dry spinning cell, wherein said top closure is adjacent to said open top portion of said dry spinning cell; and (c) a bottom closure for reducing or eliminating solvent vapor emissions and reducing or eliminating the intrusion of air into said dry spinning cell, wherein said bottom closure is adjacent to said bottom portion of said dry spinning cell; said bottom closure comprising at least one of coalescence jets or monofilament guides and a filament exit guide.

Also included is a device including:

(a) a dry spinning cell for synthetic fiber having a substantially vertical configuration, an open top portion, an open bottom portion, and an array of spinnerets;

(b) a means for reducing or eliminating solvent vapor transfer and introduction of air into said dry spinning cell; said means mounted at said open top portion; and (c) a means for reducing or eliminating solvent vapor emissions and reducing or eliminating the intrusion of air into said dry spinning cell; said means mounted at said open bottom portion.

In a further embodiment is a method for reducing or eliminating solvent vapor transfer and/or the introduction of air into a dry spinning cell including:

(a) providing a dry spinning cell for synthetic fiber having a substantially vertical configuration, an open top portion, an open bottom portion, and an array of spinnerets;

(b) mounting a top closure adjacent to said open top portion of said dry spinning cell and over said array of spinnerets; and (c) mounting a bottom closure adjacent to said bottom portion of said dry spinning cell; said bottom closure comprising coalescence jets and a filament exit guide.

DETAILED DESCRIPTION OF THE INVENTION

As used herein, spandex is a manufactured fiber in which the fiber-forming substance is a long chain synthetic elastomer including at least 85% by weight of a segmented polyurethane. Spandex is generally dry-spun from solutions of polyurethane or polyurethaneurea in solvents such as dimethylacetamide, dimethylformamide, N-methylpyrrolidone, dimethyl sulfoxide. The polymers can be prepared by capping a polymeric diol such as a polyether, polyester or polycarbonate glycol with a diisocyanate and then chain-extending the resulting capped glycol with one or more diamines or diols.

As used herein, the term "open top portion" of the spinning cell refers to the portion of the cell through which gasses, vapor and solvent may be transferred during replacement or installation of spinnerets. Applicants recognize that during typical operation, this portion of the cell is generally closed.

The closure system of some embodiments, which includes a top closure and a bottom closure for a spinning cell, can be formed as an integrated part of the spinning cell or can be added as a modification of an existing spinning cell. By isolating the spinning cell from the atmosphere and using an inert gas such as nitrogen or carbon dioxide the risk of igniting the solvent and/or emission of solvent vapor or process gas into the operating area is minimized.

Figure 1:
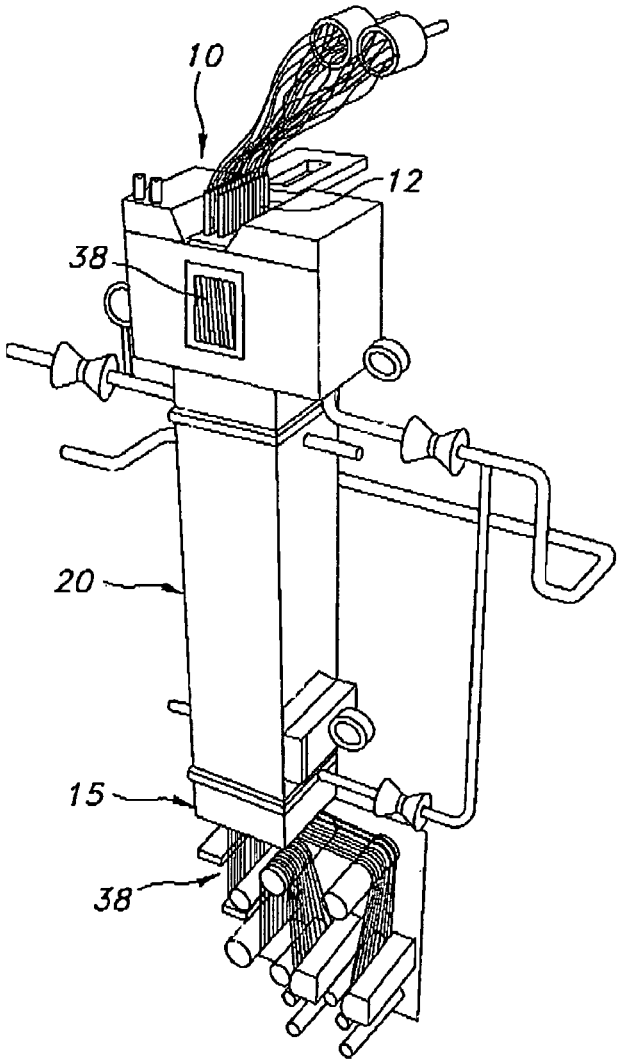
FIG. 1 shows an example of a spinning cell having open top and bottom portions.

FIG. 1 shows a spinning cell that includes a shaft 20 an open top portion 10 that is opened periodically, e.g. to perform a spinneret change and an open bottom portion 15 that is commercially used for preparing spandex filaments 38. At the top portion 10 of this device, a hot solution of polyurethane such as polyurethaneurea is pumped to the spinneret 12 where the solution is extruded into a filament 38. This spinning cell then generally uses air as the drying gas at temperatures greater than about 200° C. with about 5-10% room air drawn into the bottom of the cell to reduce solvent emission. A large volume of air is introduced into the cell to provide energy for drying and to maintain dilution of the solvent vapor in the call to avoid a potentially flammable mixture of solvent in air within the cell. This process is energy inefficient to the amount of energy needed to heat the air and then cool the solvent vapor. Also, much of the gas exits through the top cell vacuum without full utilization of the energy providing heat to the air. The filaments 38 then exit the cell at the bottom portion and are wound onto yarn packages.

The combination of the top and bottom closure devices permits the use of an inert gas such as nitrogen or carbon dioxide as the drying gas without the control of heat and gas flow rate restrictions that would otherwise be required. When the top and bottom portions are open to air, the solvent concentration within the cell must be managed to avoid explosion or fire. Solvent concentration is not an issue when the top and bottom closures are introduced as described below and oxygen is minimized or eliminated from the spinning cell.

Figure 2A:
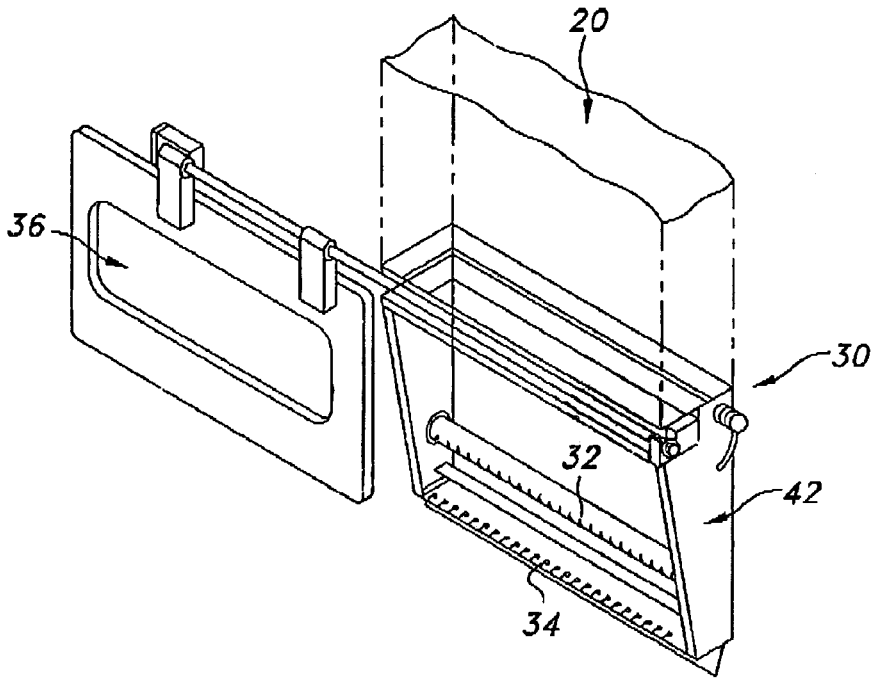
FIG. 2A is a schematic view of a spinning cell including a bottom closure.
Figure 2B:
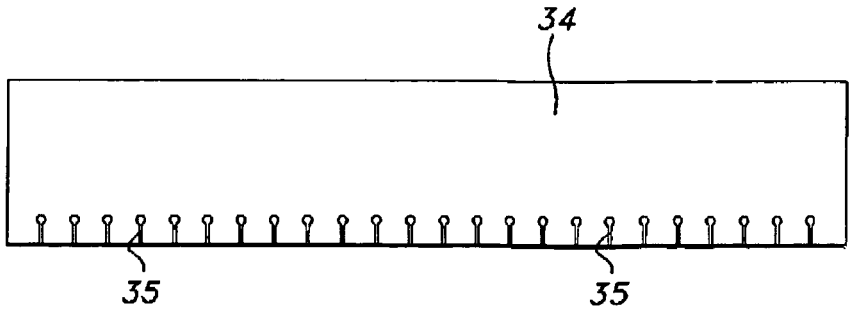
FIG. 2B is a perspective view of a filament guide.

Turning now to FIG. 2A, bottom closure section 30, which may include a coalescence jet manifold 32 and filament exit guide 34, is shown mounted at the bottom of shaft 20. The bottom closure as shown in FIG. 2A section has a cross section that converges from or is mounted to that of the spinning shaft 20 to that of filament exit guide 34, which with side door 36 and front panel 42 encloses the bottom of the spin cell. Referring to FIG. 2B, the yarn exit guide 34 contains one outlet passage 35 for each filament 38; twenty-four outlet passages are shown, however, this number may vary depending on the desired number of filaments. After exiting through the exit guide, the spandex filaments 38 can be wound up on cores to form packages.

Figure 4:
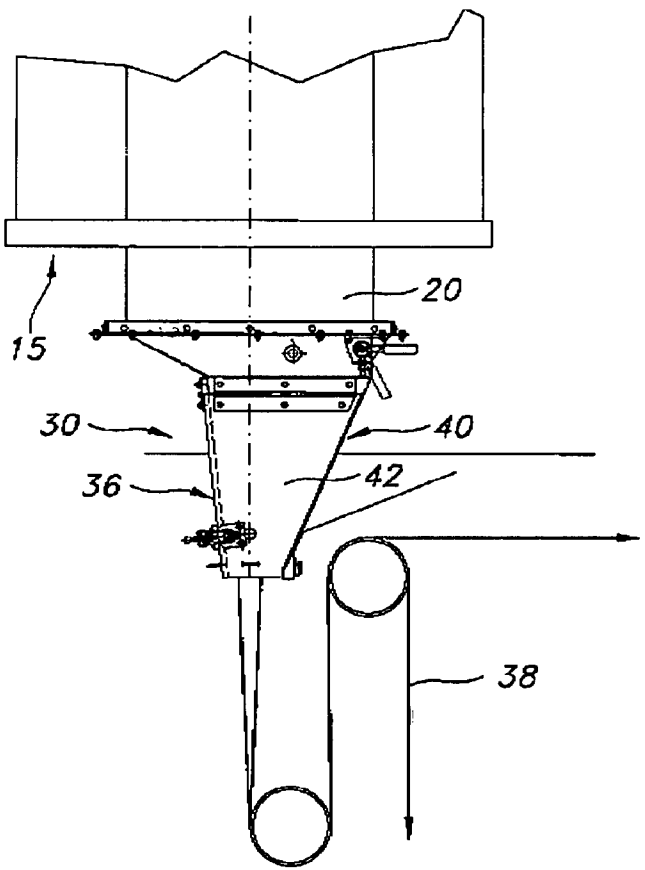
FIG. 4 is a front view of a bottom closure in the closed/operating position.
Figure 3:
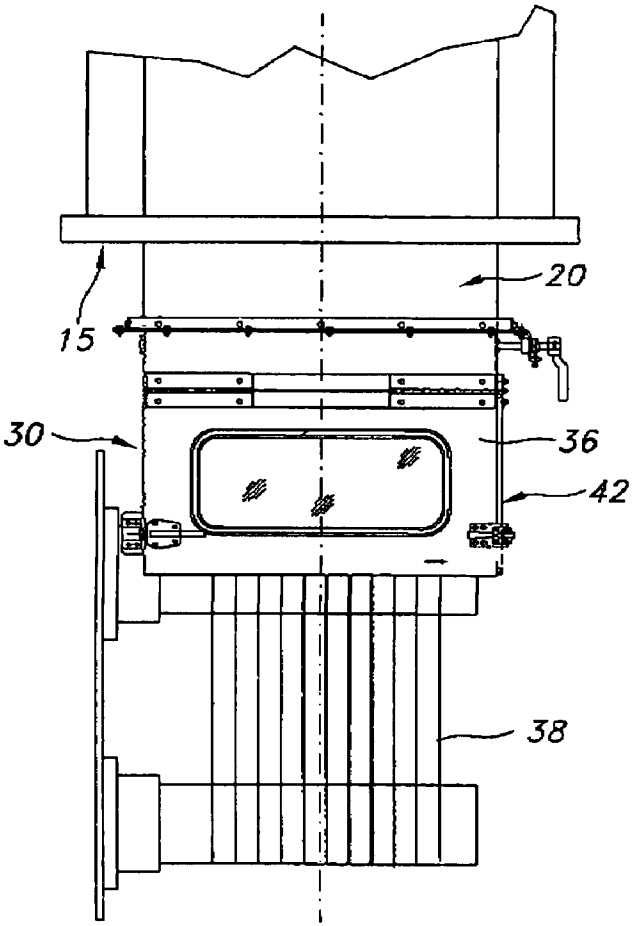
FIG. 3 is a side-view of a bottom closure in the closed/operating position.

In FIGS. 3 and 4, a bottom closure is shown from a side view and front view, respectively, in an operating position. The bottom closure is attached by extending the shaft 20 at the bottom portion of the cell 15. The bottom closure includes a side door 36 and a front door 42, which corresponds to the front panel in FIG. 2A. A side panel 40 completes the enclosure. The filaments 38 exit the bottom closure and may be wound onto a package.

Figure 6:
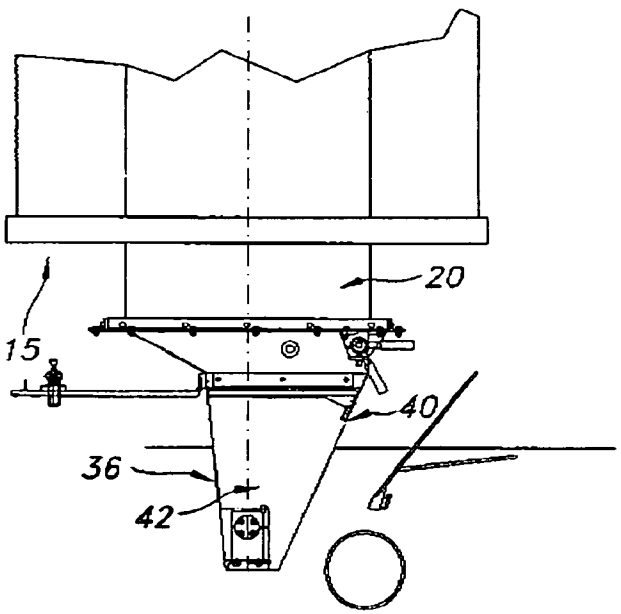
FIG. 6 is a front view of a bottom closure in the open position.
Figure 5:
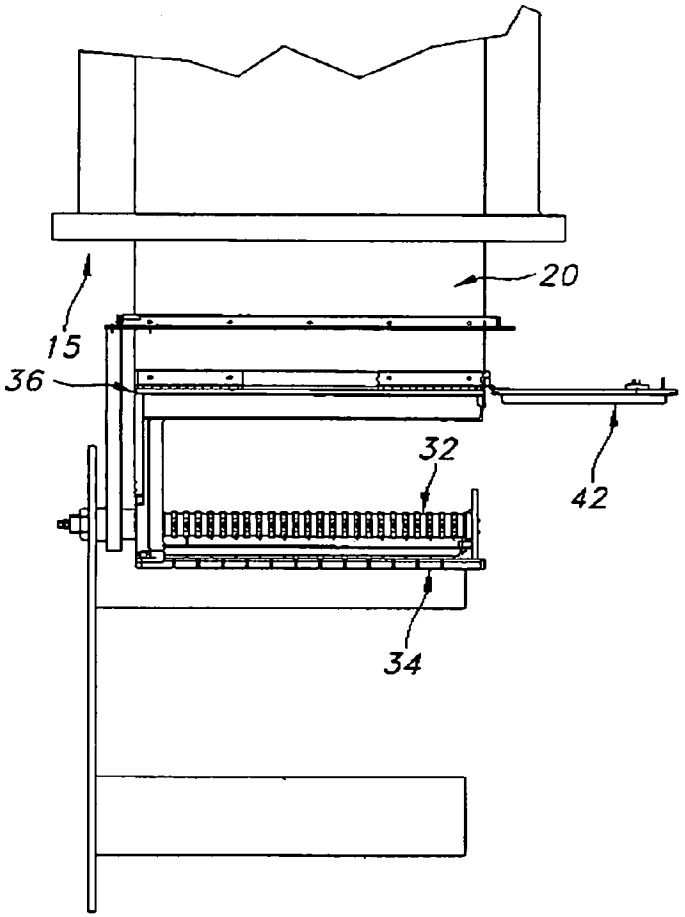
FIG. 5 is a side view of a bottom closure in the open position.

FIGS. 5 and 6 show the bottom closure in the open position from a side view and front view, respectively. The side door 36 and front door 42 are held up in an open position to expose the coalescence jet manifold 32 and filament guide 34. In order to increase access to the jet manifold, the side panel 40 may be a side door.

While a particular configuration of a cell bottom closure is provided in FIGS. 5 and 6, it is understood that other cell closure configurations may be included as the function does not rely on the shape. In addition, while the bottom closure is shown as having a side door which opens, the door(s) may slide, pivot or turn. As a further alternative, the entire bottom closure may be removable.

FIGS. 7A-7D and FIGS. 8A-8D show a cross-sectional view of the top closure device during removal and replacement of spinnerets, respectively.

FIGS. 7A-7D show the removal of a tray 26 containing an array of spinnerets 28. The array of spinnerets is includes at least one spinneret that may be in any desired configuration. In 7A, the spinning cell including shaft 20 is in operation preparing synthetic filaments 38, which may be spandex. The top closure includes an extension 24 of the shaft which may form either an integral part of the shaft 20, or may be a separate piece which has been mounted on top of an existing spinning cell. An air lock is provided by a seal plate 22 which includes a horizontal surface. At 7B, the seal plate may be lubricated to provide ease of movement with any of a variety of lubricants known for this purpose. In addition, the seal plate 22 can include a gasket to minimize leakage of gases either into or from the shaft 20. The gasket may be of any suitable soft/conforming material such as silicone or fiberglass. At FIG. 7C the seal plate 22 is moved in a horizontal direction 23 into the shaft 24 of the spinning cell as the tray 26 holding the spinnerets 28 is lifted upward in a vertical direction 25. The tray 26 including the array of spinnerets 28 may then be moved in a horizontal direction 27 away from the spinning cell.

Figure 8B:
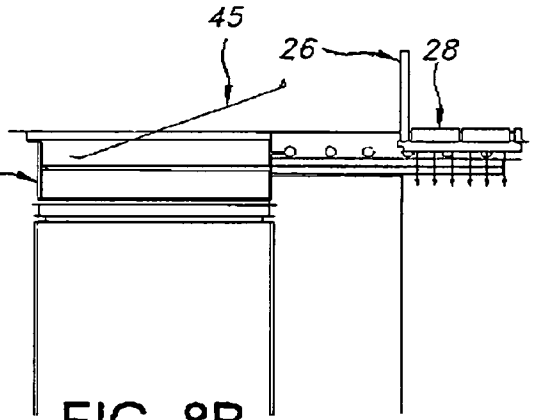
FIGS. 8A-8D are side views of the top closure at different stages of the process for installing spinnerets.
Figure 8A:
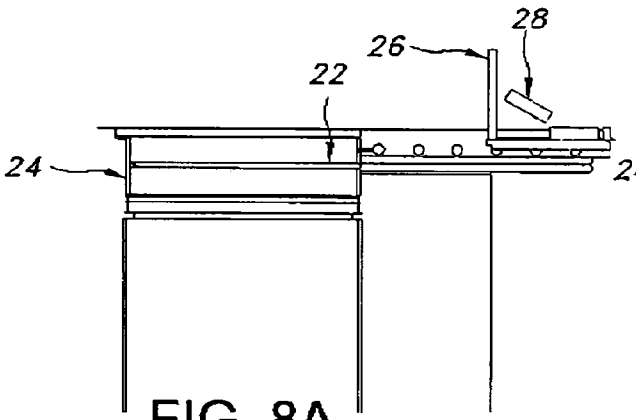
Figure 8D:
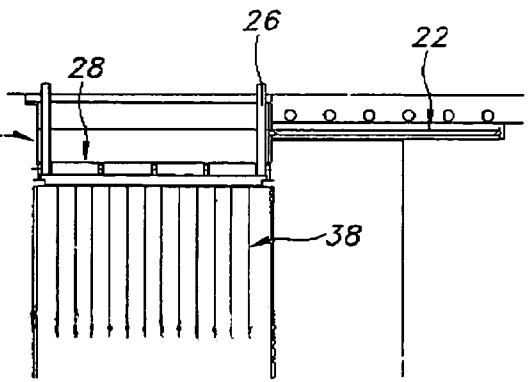

FIGS. 8A-8D show the replacement of the tray 26 including the array of spinnerets 28 to the spinning cell over the extension of the shaft 24 for resuming synthetic fiber production. FIG. 8A demonstrates that the spinnerets 28 can be removed for cleaning and then reintroduced to the tray in FIG.

Figure 8C:
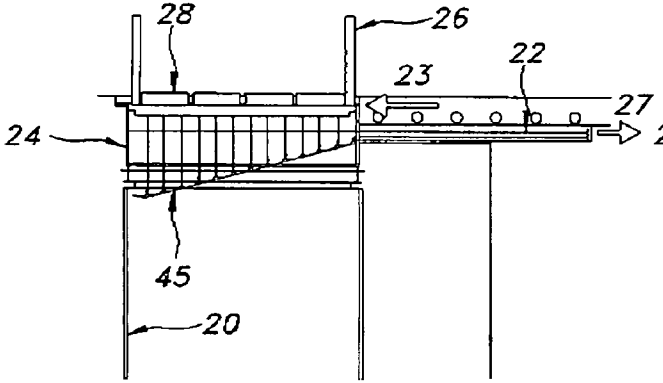

8B. and restarted. FIG. 8B. also shows the insertion of a thin sheet 45 onto seal plate 22. The thin sheet 45 may be of any suitable material such as cardboard, paper, or aluminum. In FIG. 8C, the tray 26 with thin sheet 45 is then moved horizontally 23 back over the spinning cell 20. The running thread lines deposit onto the thin sheet 45. The seal plate 22 is then removed 27 and the thin sheet with attached thread lines falls down the spinning cell shaft 20. The tray of spinnerets is then moved vertically down back into the cell to resume production of filaments 38.

Figure 9:
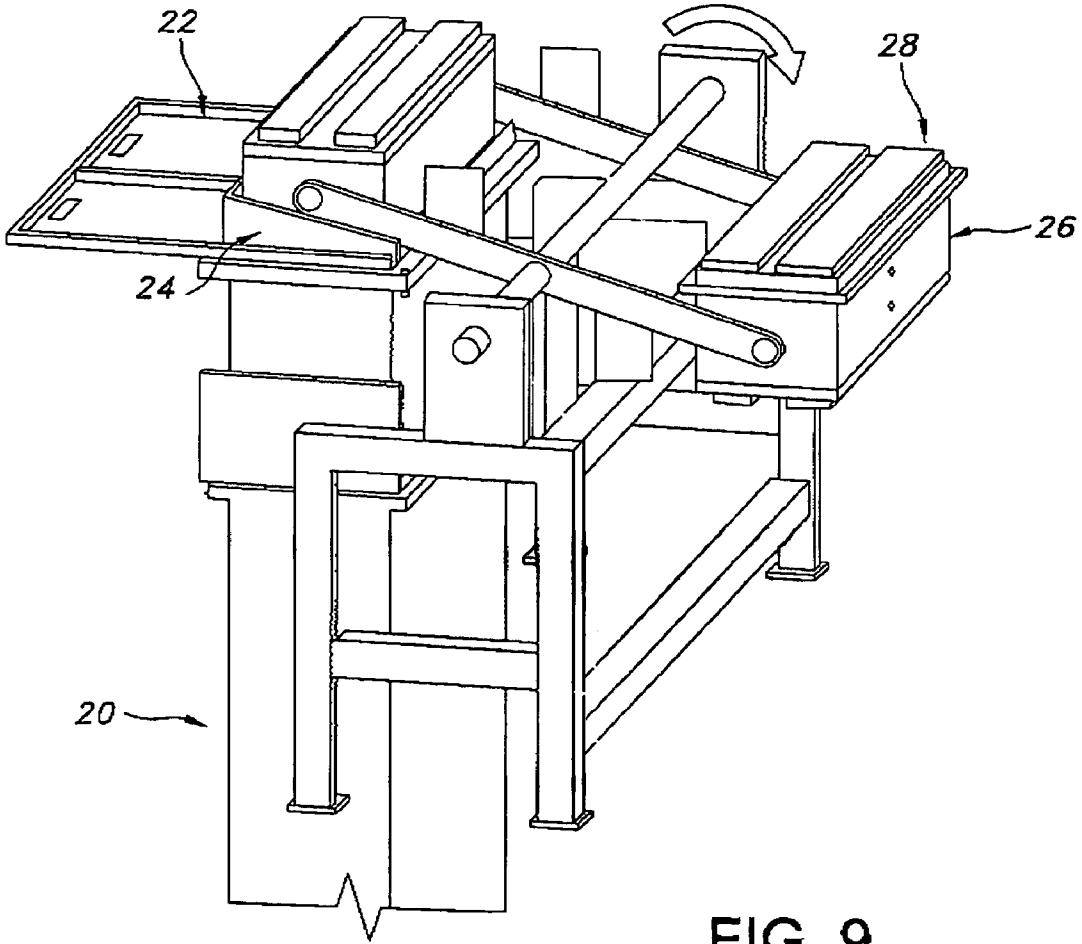
FIG. 9 is a perspective view of an alternate top closure design.

Important to note is that the configuration of the cell closure may be of any shape or geometry that corresponds to a spin cell opening and desired array of one or more spinnerets. FIG. 9 provides an alternative structure and mechanism for a top closure device of some embodiments. The tray 26 is rotatably attached to the spin cell such that after the seal plate 22 is moved into the extension of the shaft 24, the tray 26 is rotated with respect to the cell 20 to permit removal of the spinnerets 28. The tray 26 is moved from the closed/operating position 50 to the open position 60.

During the process of removing and replacing the spinnerets at the top portion of the cell, solvent vapor and process gas emission and introduction of air into the cell are minimized or eliminated. Furthermore, the air flow to the cell and heating did not need to be altered due to the air lock provided by the combination of the top closure and the bottom closure.

The features and advantages of the present invention are more fully shown by the following examples which are provided for purposes of illustration, and are not to be construed as limiting the invention in any way.

EXAMPLES

For the Examples, the measurement locations correspond to the spin cell as follows:

Location #1 at the cell top opening 10 of FIG. 1; and

Location #2, at the location of spinnerets 28 of FIG. 8A.

Example 1

$O_2$ Depletion in Operating Area Near Cell Top Opening—Original Configuration (No Top Cell or Bottom Closure)

A flow of gas flow of 500 kg/hr at approximately 20° C. into the cell through the top supply plenum containing 4-5% $O_2$ by volume with remainder being $N_2$ was established. The supply gas was recirculated in a closed loop system to minimize $N_2$ consumption with bleed-off exhaust of system gas and make-up of 99.99+% pure $N_2$ to maintain gas system pressure. The pressure inside the spin cell at the bottom was maintained at room pressure by small adjustments to the return gas flow as needed. Process gas flow returning from the cell was set at 330 kg/hr from the upper gas return plenum and 170 kg/hr from the lower gas return plenum. To assess the effect of opening the cell top to perform a spinneret change with the gas flow through the cell, the $O_2$ concentration above the top cell opening was monitored with the lower cell open at two locations (see FIG. 1). Under these conditions, the $O_2$ at the location indicated measured 17% at location #1 after 15 seconds and 4.8% at location #2 after 5 seconds.

Example 2

$O_2$ Depletion in Operating Area Near Cell Top Opening—Cell Top and Bottom Enclosure in Place Using the conditions as described in Example 1, $O_2$ readings were taken at two stages of a typical spinneret change cycle. In the first stage of the spinneret change, the spinneret is raised (as shown by the change in location of part 28 between FIGS. 7B and 7C) and the sliding pan has not yet been inserted into place (part 22 as shown in FIG. 7B). Under these conditions, no deviation from the baseline 20.8% baseline $O_2$ reading at Location #1 or Location #2 was observed.

Figure 7A:
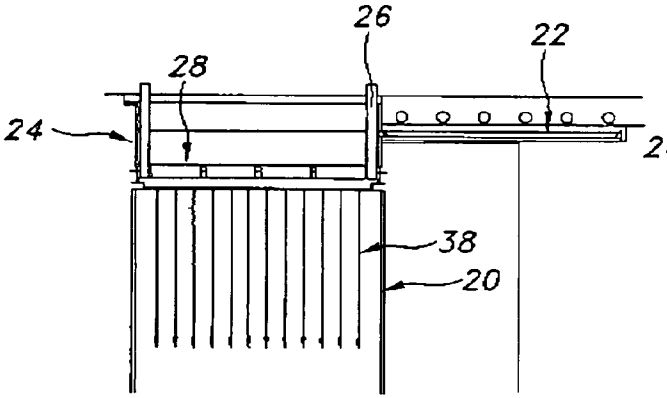
FIG. 7A-7D are side views of the top closure at different stages of the process for removing spinnerets.
Figure 7B:
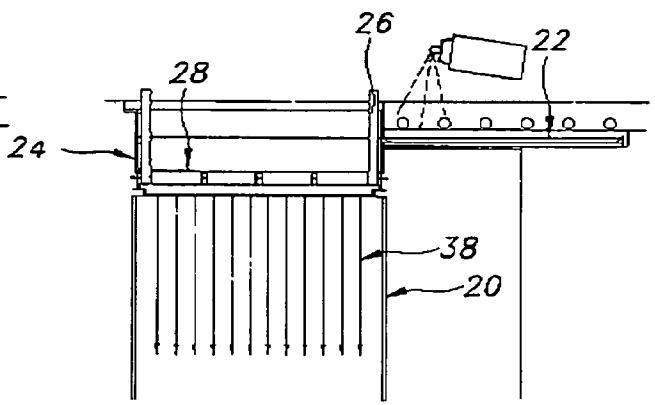
Figure 7C:
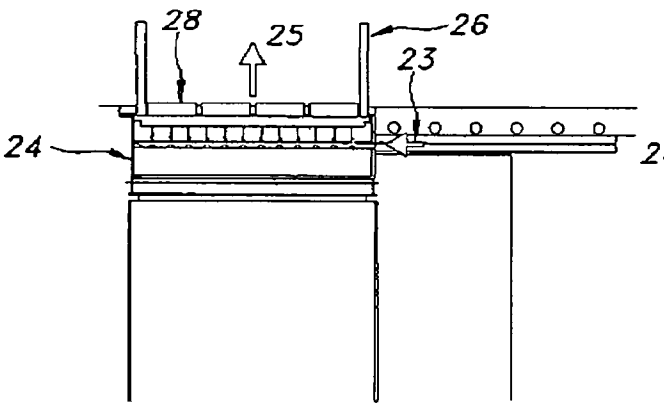
Figure 7D:
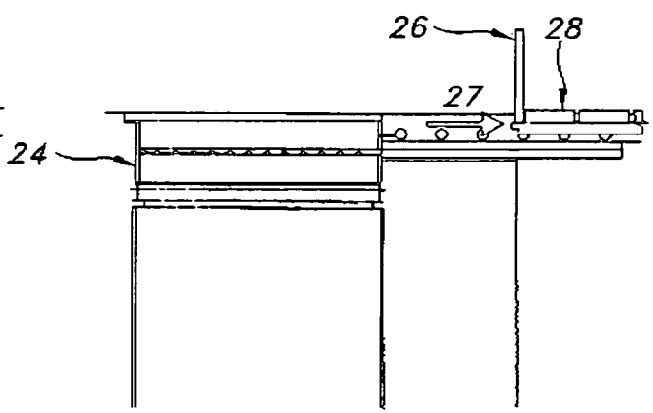

Next, the sliding pan 22 was moved into place, blocking the cell top opening 10 and the spinneret 28 was moved to its maintenance location as shown in FIG. 7D. No change in $O_2$ measurements was seen at either Location #1 or Location #2.

Example 3

$O_2$ Content of Supply Gas During Operation—Original Configuration

The spin cell was operating gas flow in to the cell through the top supply plenum with the spinneret 28 installed as shown in FIG. 7A. The supply gas was recirculated in a closed loop system to minimize $N_2$ consumption with bleed-off exhaust of system gas and make-up of 99.99+% pure $N_2$ to maintain gas system pressure. The pressure inside the spin cell at the bottom was maintained at room pressure by small adjustments to the return gas flow as needed. Gas temperature was at room temperature of approximately 235° C. throughout this test. Total gas flow into the cell through the gas supply plenum was 230 kg/hr. Process gas flow returning from the cell was set at 80 kg/hr from the upper gas return plenum. Under these conditions, the $O_2$ concentration in the upper vacuum return was measure to be 2.5% $O_2$ by volume The sliding pan or sealing plate 22 was then installed in place of the spinneret 28 in a stepwise procedure as shown in FIG. 7A through 7D with the gas flow conditions unchanged. During the course of the operation and subsequent equilibration, the $O_2$ concentration in the return gas was measured to drop to a steady-state level of approximately 1.7% $O_2$ by volume.

While the present invention has been described in an illustrative manner, it should be understood that the terminology used is intended to be in a nature of words or description rather than of limitation. Furthermore, while the present invention has been described in terms of several illustrative embodiments, it is to be appreciated that those skilled in the art will readily apply these teachings to other possible variations of the invention.

What is claimed is:

1. A device comprising:

(a) a dry spinning cell for synthetic fiber including a shaft having a substantially vertical configuration, an open top portion, an open bottom portion, and an array of spinnerets; and (b) a top closure for reducing or eliminating solvent vapor emissions and reducing or eliminating intrusion of air into said dry spinning cell, wherein said top closure is adjacent to said open top portion of said dry spinning cell;

(c) a tray forming part of said top closure and movably supported by said shaft for movement into and out from said shaft at said open top portion; and (d) a seal plate adjacent said open top portion of said shaft for removable positioning under said array of spinnerets upon removal of said spinnerets out from said open top portion;

said seal plate forming an air lock with said open top portion of said shaft to permit replacement of said spinnerets.

2. The device of claim 1, wherein said top closure includes four walls which together define an internal space of substantially the same size and dimensions of the array of spinnerets.

3. The device of claim 1 wherein said seal plate is slidable across said open top portion of said shaft.

4. The device of claim 3 wherein said seal plate is a horizontal surface.

5. The device of claim 1 further includes a bottom closure for reducing or eliminating solvent vapor emissions and the introduction of air into said dry spinning cell, wherein said bottom closure is adjacent a bottom portion of said dry spinning cell; said bottom closure comprising coalescence jets and/or a filament exit guide.

6. The device of claim 5, wherein said bottom closure comprises a front door and a side door or a front door and two opposing side doors.

7. The device of claim 6, wherein said filament exit guide is rectangular and includes slots for each threadline on one side corresponding to said side door or on opposing sides corresponding to said opposing side doors.

8. The device of claim 1 further including a thin sheet removably positioned on said seal plate.

9. The device of claim 8 wherein said thin sheet is formed from material selected from the group consisting of cardboard, paper and aluminum.

* * * * *